US008982030B2

(12) United States Patent
Siao et al.

(10) Patent No.: US 8,982,030 B2
(45) Date of Patent: Mar. 17, 2015

(54) GATE OUTPUT CONTROL METHOD AND CORRESPONDING GATE PULSE MODULATOR

(75) Inventors: Kai-Yuan Siao, Hsin-Chu (TW); Jian-Feng Li, Hsin-Chu (TW); Hsiao-Chung Cheng, Hsin-Chu (TW); Tsung-Hung Lee, Hsin-Chu (TW); Chao-Ching Hsu, Hsin-Chu (TW)

(73) Assignee: AU Optronics Corp., Hsinchu (TW)

( * ) Notice: Subject to any disclaimer, the term of this patent is extended or adjusted under 35 U.S.C. 154(b) by 1090 days.

(21) Appl. No.: 12/837,103

(22) Filed: Jul. 15, 2010

(65) Prior Publication Data

US 2011/0084894 A1 Apr. 14, 2011

(30) Foreign Application Priority Data

Oct. 13, 2009 (TW) ..... 98134665 A

(51) Int. Cl.
*G09G 3/36* (2006.01)
*G09G 3/20* (2006.01)

(52) U.S. Cl.
CPC ..... *G09G 3/20* (2013.01); *G09G 2310/0267* (2013.01)
USPC ..... 345/98

(58) Field of Classification Search
USPC ..... 345/87, 55, 88–90, 98, 204
See application file for complete search history.

(56) References Cited

U.S. PATENT DOCUMENTS

| | | | | |
|---|---|---|---|---|
| 8,120,564 | B2 * | 2/2012 | Ku et al. | 345/95 |
| 2001/0033266 | A1 * | 10/2001 | Lee | 345/94 |
| 2006/0092109 | A1 * | 5/2006 | Hsu et al. | 345/87 |
| 2008/0012813 | A1 * | 1/2008 | Yanagi et al. | 345/94 |

FOREIGN PATENT DOCUMENTS

| | | |
|---|---|---|
| JP | 5-210088 | 8/1993 |
| JP | 6-110035 | 4/1994 |

* cited by examiner

*Primary Examiner* — Pegeman Karimi
(74) *Attorney, Agent, or Firm* — WPAT, PC; Justin King

(57) ABSTRACT

A gate output control method is adapted into a flat display having a plurality of gate drive integrated circuits. The method comprises: providing a gate control signal; providing a oblique control signal to oblique modulate the gate control signal for generating a gate control signal with oblique; modulating the gate control signal with oblique to obtain a modulated gate control signal; and outputting the modulated gate control signal to the gate drive integrated circuits. A falling edge of the modulated gate control signal comprises a oblique-varying period and a vertical-varying period. In the oblique-varying period, the modulated gate control signal firstly changes to a predetermined voltage in a first slope, and then changes in a second slope until the vertical-varying period. In the vertical-varying period, the modulated gate control signal changes vertically or nearly vertically.

16 Claims, 7 Drawing Sheets

GATE OUTPUT CONTROL METHOD AND CORRESPONDING GATE PULSE MODULATOR

CROSS-REFERENCE TO RELATED APPLICATIONS

This application is based upon and claims the benefit of priority from the prior Taiwan Patent Application No. 098134665, filed Oct. 13, 2009, the entire contents of which are incorporated herein by reference.

BACKGROUND

1. Technical Field

The present invention relates to the display field, and more particularly to a gate output control method and a corresponding gate pulse modulator.

2. Description of the Related Art

Flat display (such as, liquid crystal display) has many advantages, such as high image quality, little size, light weight and wide application range, etc., thus it is widely applied into various consumption, such as mobile phone, notebook computer, desktop computer and television, etc. Therefore, the flat display has gradually substituted conventional cathode ray tube (CRT) display to be a main trend of the display.

Refer to FIG. 1, which is a schematic view of a conventional flat display. As shown in FIG. 1, the flat display 100 includes a substrate 110, a printed circuit board (PCB) 120 and a plurality of fixable circuit boards (FCB) 130. The substrate 110 has a plurality of gate drive integrated circuits (IC) GD1 and GD2, a plurality of source drive integrated circuits (not shown), and display blocks 111 and 112. The gate drive integrated circuits GD1 and GD2 are configured for controlling the display blocks 111 and 112 respectively and are coupled with each other in series through wire-on-array (WOA) technique. The printed circuit board 120 is electrically coupled to the substrate 110 through the flexible circuit boards 130, and has a timing controller 140 and a gate pulse modulator 150 disposed thereon. The timing controller 140 is configured for providing gate output enable signals YOE_Y1 and YOE_Y2 to the gate drive integrated circuits GD1 and GD2 respectively, and providing a gate control signal VGH1 and an oblique control signal to the gate pulse modulator 150 such that the gate pulse modulator 150 outputs a modulated gate control signal VGH to the gate drive integrated circuits GD1 and GD2. Then the modulated gate control signal VGH is cooperated with the gate output enable signals YOE_Y1 and YOE_Y2 to generate corresponding gate drive signals Gate Pulse_Y1 and Gate Pulse_Y2.

Refer to FIG. 2, which is a schematic view of a conventional gate pulse modulator. As shown in FIG. 2, the gate pulse modulator 150 is a pulse-width modulation integrated circuit, which includes a gate control signal terminal 151, an oblique control signal terminal 152, a discharge circuit 153 and an output terminal 154. The gate control signal terminal 151 is configured for receiving the gate control signal VGH1, the oblique control signal terminal 152 is configured for receiving the oblique control signal YV1C, and the gate pulse modulator 150 determines whether employing the discharge circuit 153 to discharge the gate control signal VGH1 for generating the modulated gate control signal VGH and employing the output terminal 154 to output the modulated gate control signal VGH to the gate drive integrated circuits GD1 and GD2 according to the oblique control signal YV1C.

Refer to FIG. 3, which is a timing chart of the gate control signal VGH1, the oblique control signal YV1C and the modulated gate control signal VGH of the gate pulse modulator as shown in FIG. 2, and the gate output enable signals YOE_Y1 and YOE_Y2, the gate drive signals Gate Pulse_Y1 and Gate Pulse_Y2 as shown in FIG. 1. As shown in FIG. 3, the modulated gate control signal VGH output from the gate pulse modulator 150 is a gate control signal with oblique, which falls to a certain voltage in a slope, and then changes in a vertical mode. In addition, since the resistance of the WOA is large, the modulated gate control signal VGH and the gate output enable signals YOE_Y1 and YOE_Y2 attenuate to generate wave-change in a process when they are transmitted to the gate drive integrated circuits GD1 and GD2, such that oblique cutoff voltages V1 and V2 of the gate drive signals Gate Pulse_Y1 and Gate Pulse_Y2 configured for driving the gate drive integrated circuits GD1 and GD2 have a voltage difference ΔV0 therebetween. Therefore, luminance of the display blocks 111 and 112 are different to generate a horizontal slight boundary. That is, the luminance is non-uniform in the perpendicular direction.

BRIEF SUMMARY

The present invention relates to a gate output control method which can effectually solve the problem of the conventional art having a non-uniform luminance in a perpendicular direction.

The present invention also relates to a gate pulse modulator which can effectually solve the problem of the conventional art having a non-uniform luminance in a perpendicular direction.

A gate output control method of the present invention is adapted into a flat display. The flat display comprises a first gate drive integrated circuit and a gate drive integrated circuit. The gate output control method comprises: providing a gate control signal; providing a oblique control signal to oblique modulate the gate control signal for generating a gate control signal with oblique; modulating the gate control signal with oblique to obtain a modulated gate control signal; and outputting the modulated gate control signal to the first gate drive integrated circuit and the second gate drive integrated circuit to control the first gate drive integrated circuit and the second gate drive integrated circuit in sequence. A falling edge of the modulated gate control signal comprises a oblique-varying period and a vertical-varying period. In the vertical-varying period, the modulated gate control signal firstly changes to a predetermined voltage in a first slope, and then changes in a second slope until the vertical-varying period. The modulated gate control signal changes vertically or nearly vertically in the vertical-varying period.

In an exemplary embodiment of the present invention, the step of providing the oblique control signal to oblique modulate the gate control signal for generating the gate control signal with oblique, comprises: determining whether employing a discharge circuit to discharge the gate control signal according to the oblique control signal.

In an exemplary embodiment of the present invention, the second slope of the modulated gate control signal is approximate 0 to make the modulated gate control signal continuously kept close to the predetermined voltage.

In an exemplary embodiment of the present invention, the step of modulating the gate control signal with oblique to obtain the modulated gate control signal is performed by a oblique constant-voltage circuit. The step comprise: employing a predetermined voltage power to provide the predetermined voltage; in the oblique-varying period, regarding the predetermined voltage provided by the predetermined voltage power as the modulated gate control signal when the gate control signal with oblique is less than the predetermined voltage.

In an exemplary embodiment of the present invention, the step of modulating the gate control signal with oblique to obtain the modulated gate control signal may also comprises: determining whether employing a second discharge circuit to further discharge the gate control signal with oblique according to a control signal, such that in the oblique-varying period the second slope of the modulated gate control signal is approximately 0 to make the modulated gate control signal continuously kept close to the predetermined voltage. When the second discharge circuit further discharges the gate control signal with oblique, the first discharge circuit continuously discharges. Alternatively, when the second discharge circuit further discharges the gate control signal with oblique, the first discharge circuit stops discharging.

In an exemplary embodiment of the present invention, the gate output control method further comprises: outputting a first enable signal and a second enable signal to the first gate drive integrated circuit and the second gate drive integrated circuit respectively to be cooperated with the modulated gate control signal for generating a first gate drive signal and a second gate drive signal. Furthermore, the first gate drive signal has an oblique cutoff voltage same to that of the second gate drive signal.

A gate pulse modulator of the present invention is adapted into a flat display. The flat display comprises a first gate drive integrated circuit and a second gate drive integrated circuit. The gate pulse modulator comprises a gate control signal terminal, an oblique control signal terminal, a first discharge circuit, an oblique output terminal, an oblique constant-voltage circuit and an output terminal. The gate control signal terminal is configured for receiving a gate control signal, the oblique control signal terminal is configured for receiving an oblique control signal, the oblique output terminal is configured for outputting a gate control signal with oblique, and the output terminal is configured for outputting a modulated gate control signal to the first gate drive integrated circuit and a second gate drive integrated circuit. The gate pulse modulator determines whether employing the first discharge circuit to discharge the gate control signal according to the oblique control signal for generating the gate control signal with oblique, and employs the oblique constant-voltage circuit to modulate the gate control signal with oblique to obtain the modulated gate control signal. A falling edge of the modulated gate control signal comprises an oblique-varying period and a vertical-varying period. In the oblique-varying period, the modulated gate control signal firstly changes to a predetermined voltage in a first slope, and then changes in a second slope until the vertical-varying period. The modulated gate control signal changes vertically or nearly vertically in the vertical-varying period.

In an exemplary embodiment of the present invention, the oblique constant-voltage circuit comprises a predetermined voltage power and a diode. The predetermined voltage power provides the predetermined voltage. A positive terminal of the diode is electrically coupled to the predetermined voltage, and a negative terminal thereof is electrically coupled to the oblique output terminal to receive the gate control signal with oblique. In the oblique-varying period, the predetermined voltage provided by the predetermined voltage power is regarded as the modulated gate control signal when the gate control signal with oblique is less than the predetermined voltage.

In an exemplary embodiment of the present invention, the oblique constant-voltage circuit may also comprise a switch and a second discharge circuit. The switch is configured for receiving a control signal, and the second discharge circuit is electrically coupled to the switch. The gate pulse modulator determines whether employing the second discharge circuit to further discharge the gate control signal with oblique according to the control signal, such that in the oblique-varying period, the second slope of the modulated gate control signal is approximately 0 to make the modulated gate control signal continuously kept close to the predetermined voltage.

The present invention employs the modulated gate control signal continuously kept close to the predetermined voltage after falling down to the predetermined voltage in the oblique-varying period, such that the gate drive signals configured for controlling the different gate drive integrated circuits have the same oblique cutoff voltages, and there are no any voltage difference among the gate drive signals configured for controlling the different gate drive integrated circuits. Therefore, the present invention can effectually solve the problem of the conventional art having a non-uniform luminance in a perpendicular direction.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Reference will now be made to the drawings to describe exemplary embodiments of the present gate output control method and corresponding gate pulse modulator in detail. The following description is given by way of example, and not limitation.

Figure 1:
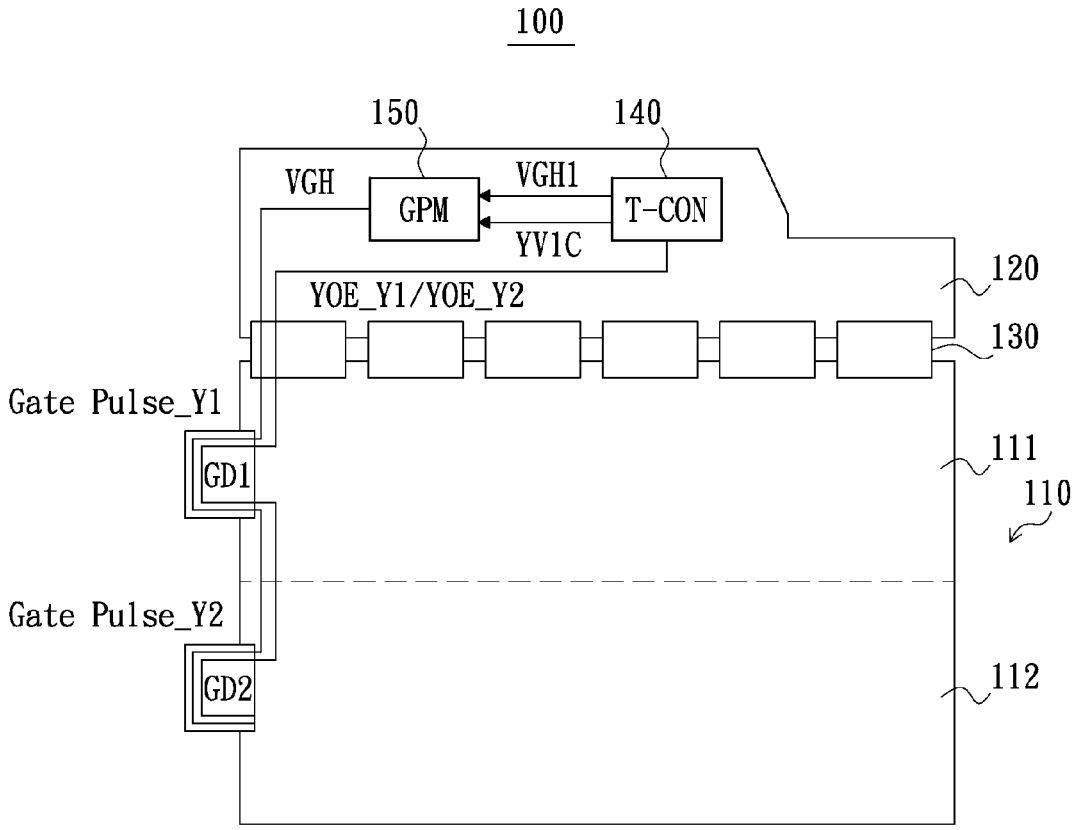
FIG. 1 (Related Art)
FIG. 1 is a structure block view of a conventional flat display.
Figure 4:
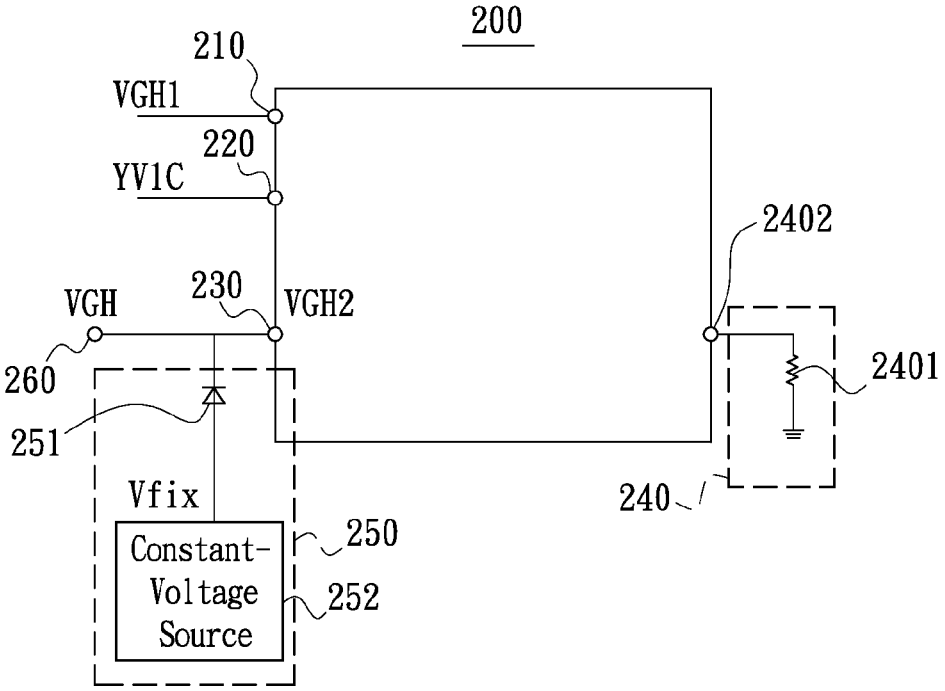
FIG. 4 is a schematic view of a gate pulse modulator in accordance with an exemplary embodiment of the present invention.
Figure 5:
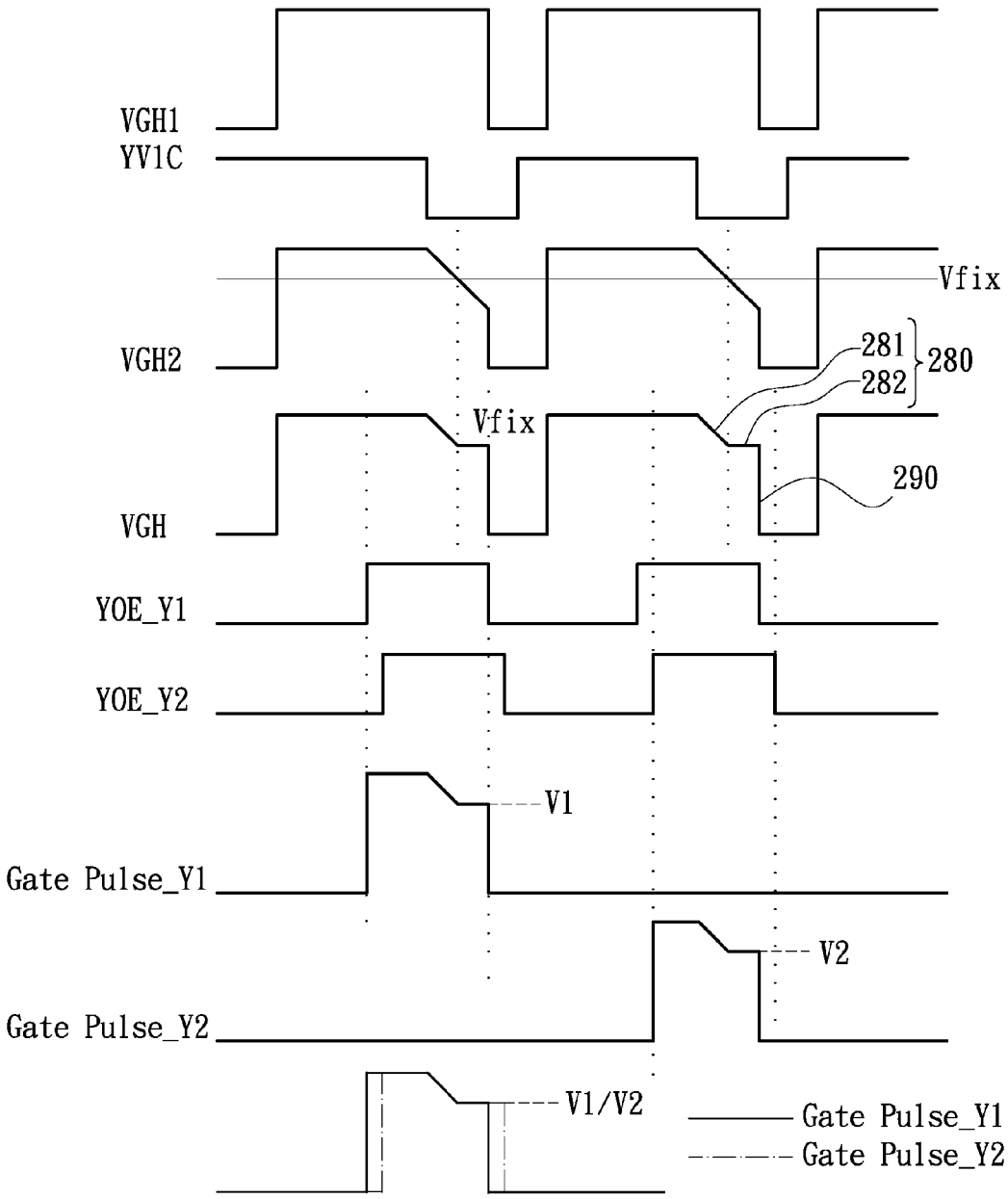
FIG. 5 is a timing chart of various signals of a gate output control method in accordance with an exemplary embodiment of the present invention.

The following describes a gate pulse modulator and a corresponding gate output control method in accordance with an exemplary embodiment of the present invention in detail cooperating with FIGS. 1, 4 and 5. FIG. 4 is a schematic view of the gate pulse modulator of the exemplary embodiment of the present invention, and FIG. 5 is a timing chart of various signals in the gate output control method of the exemplary embodiment of the present invention. The gate pulse modulator 200 disclosed in the exemplary embodiment is adapted into the flat display 100 having the gate drive integrated circuits GD1 and GD2, and the structure of the flat display 100 is described in the above description and not described in following. As shown in FIG. 4, the gate pulse modulator 200 of the exemplary embodiment includes a gate control signal terminal 210, an oblique control signal terminal 220, an oblique output terminal 230, a discharge circuit 240, an oblique constant-voltage circuit 250 and an output terminal 260.

Figure 2:
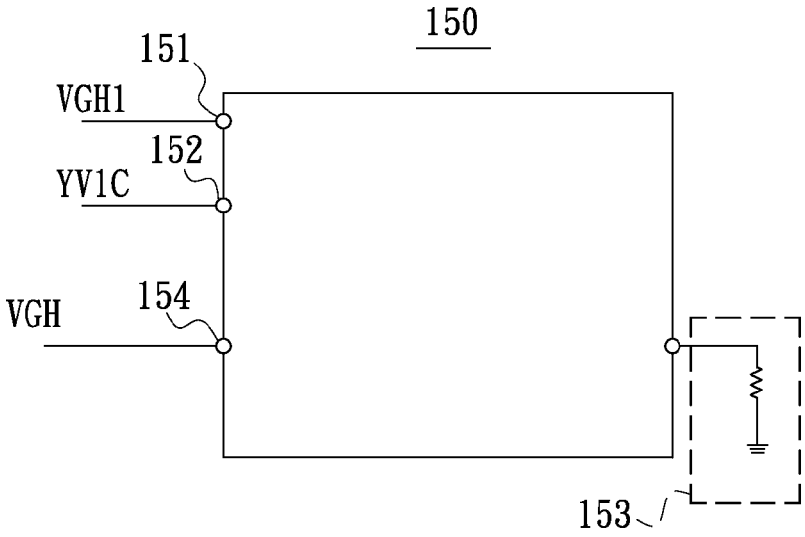
FIG. 2 (Related Art)
FIG. 2 is a schematic view of a conventional gate pulse modulator.
Figure 3:
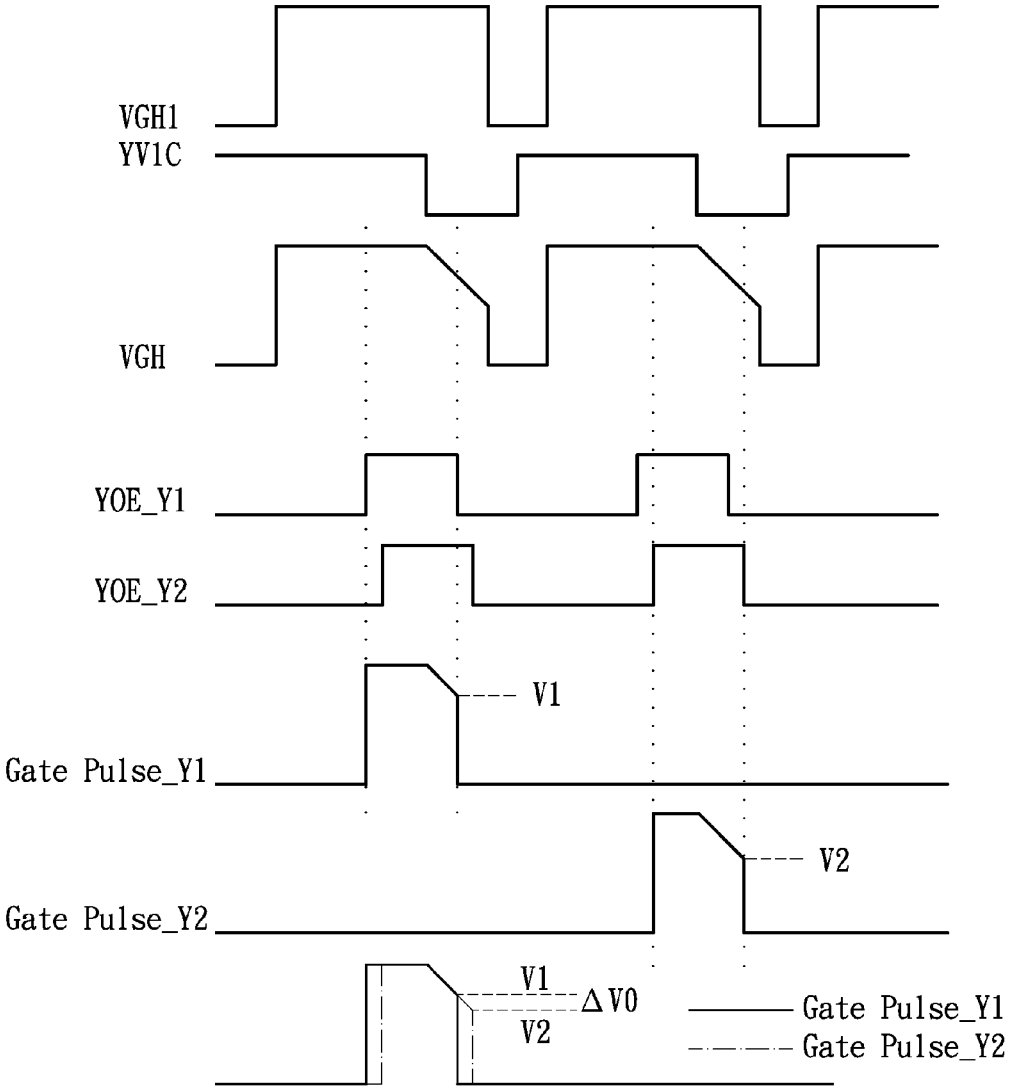
FIG. 3 is a timing chart of a gate control signal, an oblique control signal and a modulated gate control signal as shown in FIG. 2, and gate output enable signals and gate drive signals as shown in FIG. 1.

Referring to FIGS. 1 and 4-5, the gate control signal terminal 210 receives a gate control signal VGH1, the oblique control signal terminal 220 receives an oblique control signal YV1C, and the gate pulse modulator 200 determines whether employing the discharge circuit 240 to discharge the gate control signal VGH1 according to the oblique control signal YV1C for generating a gate control signal VGH2 with oblique at the oblique output terminal 230. The discharge circuit 240 includes a resistor 2401 electrically coupled between a discharge terminal 2402 and ground. The gate control signal VGH2 with oblique is same to the modulated gate control signal VGH as shown in FIGS. 2 and 3, thus it is obvious for persons skilled in the art and not described in following.

The oblique constant-voltage circuit 250 is configured for modulating the gate control signal VGH2 with oblique to obtain a modulated gate control signal VGH. A falling edge of the modulated gate control signal VGH includes a oblique-varying period 280 and a vertical-varying period 290. In the oblique-varying period 280, the modulated gate control signal VGH firstly changes to a predetermined voltage Vfix in a first slope 281, and then changes in a second slope 282 until the vertical-varying period 290. Furthermore, in the vertical-varying period 290, the modulated gate control signal VGH changes the voltage vertically or nearly vertically.

In this exemplary embodiment, the second slope of the modulated gate control signal VGH is 0 such that the modulated gate control signal VGH is kept in the predetermined voltage Vfix. In detail, the oblique constant-voltage circuit 250 of the exemplary embodiment includes a diode 251 and a constant-voltage source 252. A positive terminal of the diode 251 is electrically coupled to the constant-voltage source 252 to receive the predetermined voltage Vfix provided by the constant-voltage source 252, and a negative terminal of the diode 252 is electrically coupled to the oblique output terminal 240 to receive the gate control signal VGH2 with oblique. In the oblique-varying period 280, when the gate control signal VGH2 with oblique is larger than the predetermined voltage Vfix, the diode 251 turns off, such that the output terminal 260 of the gate pulse modulator 200 outputs the gate control signal VGH2 with oblique as the modulated gate control signal VGH. When the gate control signal VGH2 with oblique is less than the predetermined voltage Vfix, the diode 251 turns on, such that the output terminal 260 of the gate pulse modulator 200 outputs the predetermined voltage Vfix as the modulated gate control signal VGH. Therefore, the oblique constant-voltage circuit 250 can make the second slope of the modulated gate control signal VGH be 0 such that the modulated gate control signal VGH is continuously kept in the predetermined voltage Vfix.

Then the modulated gate control signal VGH is output to the gate drive integrated circuits GD1 and GD2 of the flat display 100 as shown in FIG. 1, and is cooperated with the enable signals YOE_Y1 and YOE_Y2 output to the gate drive integrated circuits GD1 and GD2 respectively, to generate corresponding gate drive signals Gate Pulse_Y1 and Gate Pulse_Y2. As shown in FIG. 5, since the modulated gate control signal VGH is continuously kept in the predetermined voltage Vfix in a mode of the second slope being 0 after falling down to the predetermined voltage Vfix in the oblique-varying period 280, oblique cutoff voltages V1 and V2 of the gate drive signals Gate Pulse_Y1 and Gate Pulse_Y2 are same, and are both kept in the predetermined voltage Vfix, that is, V1=V2=Vfix. Therefore, there is not a voltage difference between the oblique cutoff voltages V1 and V2 of the gate drive signals Gate Pulse_Y1 and Gate Pulse_Y2, that is, V1−V2=ΔV=0.

Figure 6:
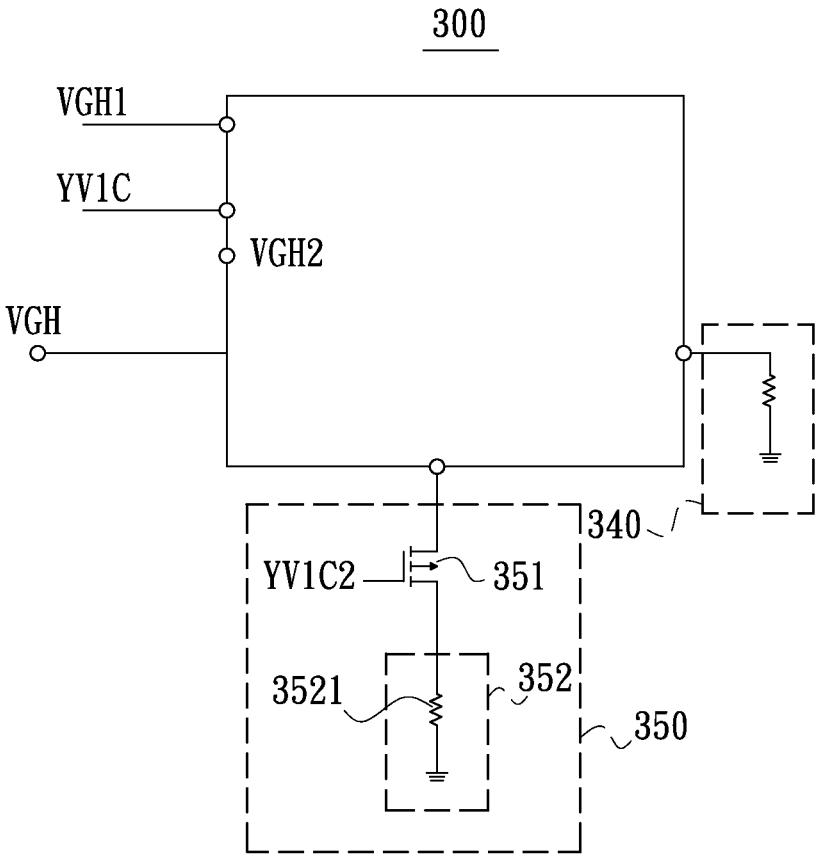
FIG. 6 is a schematic view of a gate pulse modulator in accordance with another exemplary embodiment of the present invention.
Figure 7:
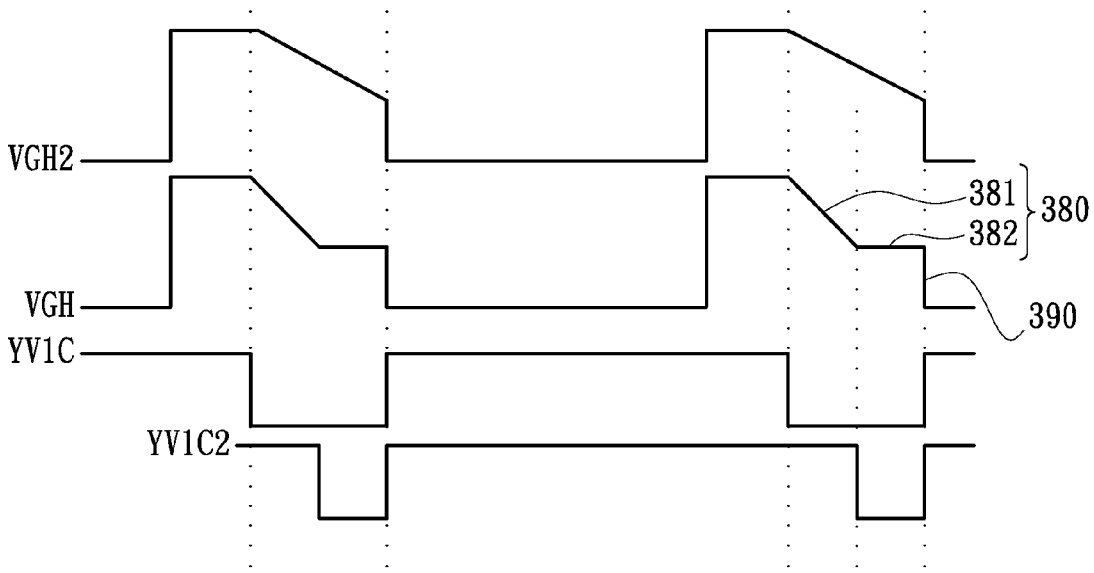
FIG. 7 is a timing chart of various signals of a gate output control method in accordance with another exemplary embodiment of the present invention.

Refer to FIGS. 6 and 7, which are schematic views of a gate pulse modulator and a corresponding gate output control method thereof in accordance with another exemplary embodiment of the present invention. As shown in FIGS. 6 and 7, the gate pulse modulator 300 of the exemplary embodiment is similar with the gate pulse modulator 200 as shown in FIG. 4, except that the oblique constant-voltage circuit 350 of the gate pulse modulator 300 of the exemplary embodiment includes a switch 351 and a discharge circuit 352 electrically coupled to the switch 351. The switch 351 receives a control signal YV1C2, and determines whether employing the discharge circuit 352 to further discharge the gate control signal VGH2 with oblique according to the control signal YV1C2, such that in the oblique-varying period 380, the modulated gate control signal VGH changes in the second slope 382 until the vertical-varying period 390. The discharge circuit 352 includes a resistor 3521 electrically coupled between the switch 351 and ground. The second slope can change by adjusting the resistance value of the resistor 3521. In this exemplary embodiment, the resistance value of the resistor 3521 may be designed to make the second slope be approximately 0, such that the modulated gate control signal is continuously kept close to the predetermined voltage Vfix. That is, the gate pulse modulator 300 of the exemplary embodiment employs the discharge circuits 340 and 350 to perform two discharge operations, such that the modulated gate control signal VGH changes in the first slope 381, and then changes in the second slope 382 toward 0 to make the modulated gate control signal VGH continuously be kept close to the predetermined voltage Vfix.

In addition, as shown in FIG. 7, in the exemplary embodiment, when the discharge circuit 352 discharges the gate control signal VGH2 with oblique, at this moment the discharge circuit 340 continuously discharges the gate control signal VGH2 with oblique. Of course, it is obvious for persons skilled in the art that when the discharge circuit 352 discharges the gate control signal VGH2 with oblique, the discharge circuit 340 stops discharging and only the discharge circuit 352 performs the discharge operation.

Furthermore, the gate drive integrated circuits GD1 and GD2 of the present invention are not limited to be electrically coupled in series with each other. Alternatively, they may be electrically coupled in parallel with each other through the WOA. It should be noted that, the gate output control method and the gate pulse modulator of the present invention is not limited to be applied into the flat display including two gate drive integrated circuits, and they may be applied into the flat display including a plurality of (such as three or more than three) gate drive integrated circuits. The present invention makes the modulated gate control signal VGH continuously kept close to the predetermined voltage Vfix after falling down to the predetermined voltage Vfix such that there are no any voltage difference among the gate drive signals output to the plurality of gate drive integrated circuits.

In summary, the present invention makes the modulated gate control signals continuously kept close to the predetermined voltage after falling down to the predetermined voltage in the oblique-varying period, such that the gate drive signals configured for controlling the different gate drive integrated circuits have the same oblique cutoff voltages, and there are no any voltage difference among the gate drive signals configured for controlling the different gate drive integrated circuits. Therefore, the present invention can solve the problem of the conventional art having the non-uniform luminance in the perpendicular direction.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A gate output control method adapted into a flat display, the flat display comprising a first gate driving circuit and a second gate driving circuit, the gate output control method comprising:

providing a gate control signal;

providing an oblique control signal to oblique modulate the gate control signal for generating a gate control signal with oblique;

modulating the gate control signal with oblique to obtain a modulated gate control signal, wherein a falling edge of the modulated gate control signal comprises a sequence of a first slope, a horizontal section, and then a vertical section; and outputting the modulated gate control signal to the first gate driving circuit and the second gate driving circuit, wherein the first gate driving circuit and the second gate driving circuit output according to the modulated gate control signal with the sequence of the first slope, the horizontal section, and then the vertical section.

2. The gate output control method as claimed in claim 1, wherein the step of providing the oblique control signal to oblique modulate the gate control signal for generating the gate control signal with oblique comprises:

determining whether employing a first discharge circuit to discharge the gate control signal according to the oblique control signal.

3. The gate output control method as claimed in claim 2, wherein the horizontal section of the modulated gate control signal has a second slope approximately 0 to make the modulated gate control signal continuously kept close to a predetermined voltage.

4. The gate output control method as claimed in claim 3, wherein the step of modulating the gate control signal with oblique to obtain the modulated gate control signal is performed by an oblique constant-voltage circuit.

5. The gate output control method as claimed in claim 4, wherein the step of modulating the gate control signal with oblique to obtain the modulated gate control signal comprises:

employing a constant-voltage source to provide the predetermined voltage; and employing the predetermined voltage provided by the constant-voltage source as the modulated gate control signal when the gate control signal with oblique is less than the predetermined voltage in the oblique-varying period.

6. The gate output control method as claimed in claim 4, wherein the step of modulating the gate control signal with oblique to obtain the modulated gate control signal comprises:

determining whether employing a second discharge circuit to further discharge the gate control signal with oblique according to a control signal to make the second slope of be approximately 0 in the horizontal section for making the modulated gate control signal continuously kept close to the predetermined voltage.

7. The gate output control method as claimed in claim 6, wherein when the second discharge circuit further discharges the gate control signal with oblique, the first discharge circuit continuously discharges.

8. The gate output control method as claimed in claim 6, wherein when the second discharge circuit further discharges the gate control signal with oblique, the first discharge circuit stops discharging.

9. The gate output control method as claimed in claim 3, further comprising:

outputting a first enable signal and a second enable signal to the first gate driving circuit and the second gate driving circuit respectively to be cooperated with the modulated gate control signal for generating a first gate drive signal and a second gate drive signal;

wherein the first gate drive signal has an oblique cutoff voltage same to that of the second gate drive signal.

10. A gate pulse modulator adapted into a flat display, the flat display comprising a first gate driving circuit and a second gate driving circuit, the gate pulse modulator comprising:

a gate control signal terminal configured for receiving a gate control signal;

an oblique control signal terminal configured for receiving an oblique control signal;

a first discharge circuit;

an oblique output terminal configured for outputting a gate control signal with oblique;

an oblique constant-voltage circuit; and an output terminal configured for outputting a modulated gate control signal to the first gate driving circuit and the second gate driving circuit;

wherein the gate pulse modulator determines whether employing the first discharge circuit to discharge the gate control signal according to the oblique control signal for generating the gate control signal with oblique, and the gate pulse modulator employs the oblique constant-voltage circuit to modulate the gate control signal with oblique to obtain the modulated gate control signal, a falling edge of the modulated gate control signal comprises a sequence of a first slope, a horizontal section, and then a vertical section; and wherein the first gate driving circuit and the second gate driving circuit output according to the modulated gate control signal with the sequence of the first slope, the horizontal section, and then the vertical section.

11. The gate pulse modulator as claimed in claim 10, wherein the horizontal section second slope of the modulated gate control signal has a second slope approximately 0 to make the modulated gate control signal continuously kept close to a predetermined voltage.

12. The gate pulse modulator as claimed in claim 11, wherein the oblique constant-voltage circuit comprises:

a constant-voltage source configured for providing the predetermined voltage; and a diode, a positive terminal thereof being electrically coupled to the predetermined voltage, and a negative terminal thereof being electrically coupled to the oblique output terminal to receive the gate control signal with oblique;

wherein, in the oblique-varying period, the predetermined voltage provided by the constant-voltage source is regarded as the modulated gate control signal when the gate control signal with oblique is less than the predetermined voltage.

13. The gate pulse modulator as claimed in claim 11, wherein the oblique constant-voltage circuit comprises:

a switch configured for receiving a control signal; and a second discharge circuit electrically coupled to the switch;

wherein the control signal is configured for determining whether employing the second discharge circuit to further discharge the gate control signal with oblique, such that the second slope is approximately 0 in the horizontal section to make the modulated gate control signal continuously kept close to the predetermined voltage.

14. The gate pulse modulator as claimed in claim 13, wherein the second discharge circuit comprises a resistor electrically coupled between the switch and ground.

15. The gate pulse modulator as claimed in claim 14, wherein the second slope is capable to be changed by adjusting a resistance value of the resistor.

16. The gate pulse modulator as claimed in claim 10, wherein the first discharge circuit comprises a resistor electrically coupled between a first discharge terminal and ground.

* * * * *